US005201007A

United States Patent [19]

Ward et al.

[11] Patent Number: 5,201,007

[45] Date of Patent: * Apr. 6, 1993

[54] APPARATUS AND METHOD FOR CONVEYING AMPLIFIED SOUND TO EAR

[75] Inventors: Gary L. Ward; M. Duncan MacAllister, both of Roanoke, Va.

[73] Assignee: Epic Corporation, Hardy, Va.

[ * ] Notice: The portion of the term of this patent subsequent to Jul. 9, 2008 has been disclaimed.

[21] Appl. No.: 656,186

[22] PCT Filed: Sep. 14, 1989

[86] PCT No.: PCT/US89/04126

§ 371 Date: Mar. 5, 1991

§ 102(e) Date: Mar. 5, 1991

Related U.S. Application Data

[63] Continuation-in-part of Ser. No. 244,398, Sep. 15, 1988.

[51] Int. Cl.[5] ..... H04R 25/00

[52] U.S. Cl. ..... 381/68.6; 181/130; 181/135

[58] Field of Search ..... 381/68.6; 181/130, 132, 181/133, 134, 135

[56] References Cited

U.S. PATENT DOCUMENTS

| | | | |
|---|---|---|---|
| 2,939,923 | 6/1960 | Henderson | 381/68.6 |
| 3,209,082 | 9/1965 | McCarrell et al. | 381/68.6 |
| 4,375,016 | 2/1983 | Harada | 181/135 |
| 5,031,219 | 7/1991 | Ward et al. | 381/68.6 |

*Primary Examiner*—Jin F. Ng
*Assistant Examiner*—Edward Lefkowitz
*Attorney, Agent, or Firm*—Rogers & Killeen

[57] ABSTRACT

An earmold and a method of manufacturing an earmold for a hearing aid that conveys amplified sound from the hearing aid into the ear canal to a closed cavity adjacent the tympanic membrane. The earmold includes an acoustic conduction tube having an external diameter smaller than the ear canal and a flexible flanged tip that exerts negligible pressure on the wall of the canal. One end of the tube is held in place in the canal by the flanged tip. The opposite end of the tube may be positioned in the ear aperture by a fitting in the ear concha that may be integral with the tube. The hearing aid and the earmold leave the canal open preferably to a point past the canal isthmus.

28 Claims, 3 Drawing Sheets (ANATOMY OF THE EAR)

APPARATUS AND METHOD FOR CONVEYING AMPLIFIED SOUND TO EAR

BACKGROUND OF THE INVENTION

This is a continuation-in-part of U.S. patent application Ser. No. 244,398, filed Sep. 15, 1988.

The present invention relates to hearing aids and, more particularly, to earmolds that convey amplified sound from the hearing aid to the ear.

Audiologists have long sought to provide an earmold for a hearing aid that prevents the amplified sound from feeding back and interfering with the operation of the hearing aid and, simultaneously, to provide an earmold that is comfortable to wear. The hearing aid art is replete with devices that are able to meet one, but not both, of these objectives.

Feedback is the distortion of amplified sound caused by conduction of the amplified sound back to the microphone that receives the unamplified sound. Conduction occurs through the air pathway between the microphone and receiver in the hearing aid (acoustic feedback), and through the contact between the receiver and the surrounding housing (mechanical feedback). For hearing aid users with a profound hearing loss at several or all frequencies, the acoustic feedback problem is exacerbated by the need to generate abnormally loud sounds in the ear canal. For users with a partial hearing loss (for example, loss of hearing at high frequencies), resolution of the acoustic feedback problem is complicated by the need to amplify sound at some frequencies and to leave other frequencies unamplified.

The parts of the ear's anatomy pertinent to this invention are shown in FIG. 1. The ear canal 10 extends from the ear aperture 20 to the tympanic membrane 30. While canal size and shape may vary from person to person, it is generally about 24 millimeters long and has an S-shape. In cross section it is an oval with the major axis in the vertical direction near the aperture 20 and in the horizontal direction near the tympanic membrane 30. The cross-sectional area of the canal decreases at the isthmus 40 approximately 18 millimeters from the aperture. The canal is formed from cartilage 12 and bone 16 and is lined with skin. The cartilaginous portion is nearest the aperture 20 and is about 8 millimeters long. The osseous portion, formed from the temporal bone 16, is about 16 millimeters long. The temporal bone 16 also contains the cavities of the middle and inner ear. The region outside the ear canal adjacent the aperture 20 forms a bowl known as the concha 50.

Both the ear's anatomy and an incomplete understanding of the hearing process contribute to the failure to produce a hearing aid for both profound and partial hearing loss that comfortably reduced acoustic feedback. It is known, however, that the bones in the skull play an important role in hearing. The ear receives sound waves through the mechanisms of air conduction and bone conduction. Sound waves in the air move through an air conduction pathway (the ear canal) to the tympanic membrane, where they are conveyed to the inner ear. Sound waves also are received by the temporal bone of the skull and conveyed directly to the inner ear. In the inner ear sounds from both sources are joined to produce the full frequency spectrum of hearing. It is believed that the process of hearing may also include the reception of the pressure of acoustic waves on various neural receptors in the body which are relayed to the brain for interpretation along with the inner ear's signals.

Even if the body's methods for receiving and interpreting the various sensory signals which produce hearing were completely understood, and they are not, the hearing process is further complicated by the fact that the major signal source, the inner ear, receives acoustic signals which are complex waveforms dependent upon the size, shape, porosity, et cetera of the ear canal and its surrounding tissue. Sounds received within the ear canal are reflected, refracted and, in part absorbed by the ear canal and its surrounding structure. The sound which arrives at the ear drum has been altered by the various wave reflections and refractions within the ear canal and the head. Thus, the normal open-ear hearing process includes complex and little understood phase relationships among sounds arriving from the air and bone conduction paths. The loss or distortion of one of these paths by artificial devices can disrupt the normal phase relationships of the arriving signals.

One approach to reducing acoustic feedback in hearing aids has focused on blocking the air-conduction pathway. An acoustic barrier is placed in the ear between the receiver of the hearing aid and the outlet for the amplified sound. In one approach, the barrier is held in place by exerting pressure against the osseous and cartilaginous portions of the ear canal. See, for example, U.S. Pat. No. 4,006,796 to Coehorst dated Feb. 8, 1977, and U.S. Pat. No. 4,520,236 to Gauthier dated May 28, 1985. This pressure can be uncomfortable to the wearer and often results in the receding of the osseous and cartilaginous portions of the canal away from the pressure, i.e., the canal becomes greater in diameter. Because the barrier conducts amplified sound to the temporal bone, the normal phase relationships among sounds arriving from the air and bone conduction paths can be disrupted.

Other approaches have eliminated the pressure on the wall of the osseous portion of the canal and sealed the ear canal at the aperture or in the cartilaginous portions of the canal to obtain the desired reduction in feedback along the canal. See, for example, U.S. Pat. No. 3,061,689 to McCarrell, et al., dated Oct. 30, 1962, U.S. Pat. No. 3,312,789 to Lewis, et al., dated Apr. 4, 1967, and U.S. Pat. No. 2,939,923 to Henderson dated Jun. 7, 1960. These devices, however, do not deal with other problems caused by sealing the ear canal. These problems, insertion loss and occlusion effect, cause the hearing aid to produce sounds which are both unnatural and uncomfortable for the wearer.

Insertion loss is the removal of a portion of sound from the ear canal. Occlusion effect is the increased transmission of sound by bone conduction when air conduction is impeded. For example, one's own voice sounds different when one talks with his ears blocked. (See also, pp. 204–206 of "Bone Conduction" by Juergen Tonndorf in *Foundations of Modern Auditory Theory*, edited by Jerry V. Tobias, Vol. 2, pg. 197, Academic Press, New York.)

For those hearing aid users with partial hearing, the means to seal the ear canal in the devices in the above-cited patents indiscriminately disrupt the phase relationships for all frequencies, even those to which the otherwise malfunctioning ear may be responsive.

The present invention recognizes that the complex phase relationships of air and bone conduction are not completely understood. It creates a nearly natural hearing environment by reducing the interference with these complex relationships. Rather than blocking the ear canal with a massive seal, it opens the canal; rather than exerting pressure on the wall of the canal, it reduces wall contact. It reduces both feedback and insertion loss, and all but eliminates occlusion effect.

The present invention creates a critically tuned resonant cavity in the ear canal next to the tympanic membrane. The cavity is bounded by the wall of the canal, by the tympanic membrane, and by a flexible seal positioned in the canal, preferably between the isthmus and the tympanic membrane. The unimpeded sound received at the ear aperture moves relatively unimpeded through the canal until it reaches the face of the flexible seal nearest the aperture. Amplified sound from the hearing aid is conveyed through the ear canal inside the conduction tube and is released from the tube inside the resonant cavity. The flexible seal (whose primary function is to reduce acoustic feedback through the air conduction pathway) retains many of the natural phase relationships by (1) leaving much of the canal exposed to unamplified sound, and (2) vibrating at the frequencies of the unamplified sound. Because much of the canal is exposed, hearing aid users with normal hearing at particular frequencies are able to hear nearly natural sounds at those frequencies. Amplified sounds at the frequencies at which hearing is impaired are enhanced by the action of the resonant cavity. The resonant cavity restores much of the natural fullness of the sound by being in harmony with the frequencies of the unamplified sound.

It is accordingly an object of the present invention to provide a novel earmold for a hearing aid which obviates may of the problems of the prior art and which retains a substantial part of the natural hearing process.

It is another object of the present invention to reduce hearing aid feedback by exposing much of the ear canal to unamplified sound.

It is yet another object of the present invention to increase hearing aid user comfort by reducing the pressure on the wall of the ear canal.

It is a further object of the present invention to improve hearing aid performance and comfort by retaining many of the natural phase relationships among the sound pathways.

It is still a further object of the present invention to create a resonant cavity next to the tympanic membrane for retaining many of the natural phase relationships of the amplified frequencies.

It is yet a further object of the present invention to provide a method for making an earmold for a hearing aid that reduces feedback and is comfortable to wear.

These and many other objects and advantages will be readily apparent to one skilled in the art to which this invention pertains from a perusal of the claims and the following detailed description of preferred embodiments when read in conjunction with the appended drawings.

THE DRAWINGS

DETAILED DESCRIPTION OF PREFERRED EMBODIMENTS

Figure 1:
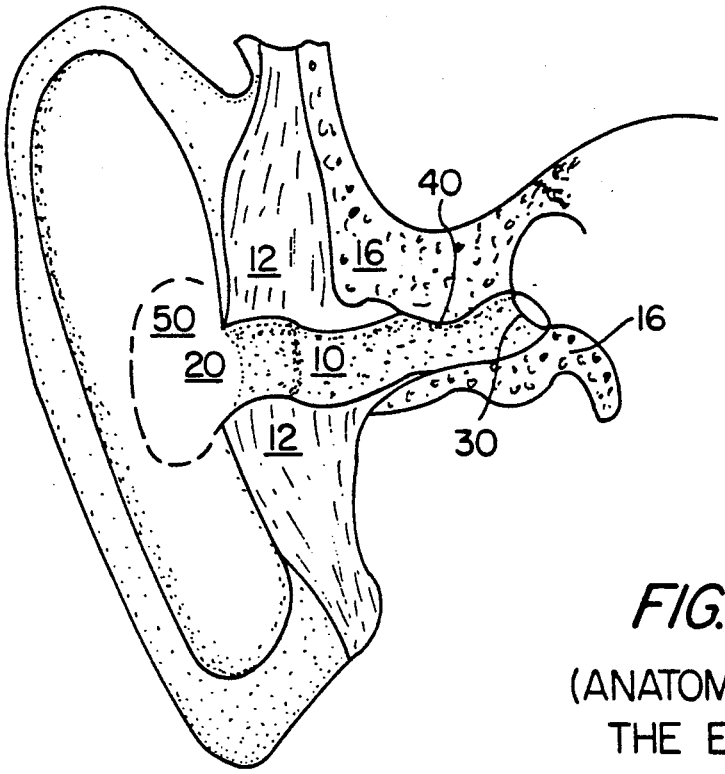
FIG. 1 is a pictorial representation of a cross section of a human ear showing pertinent anatomical features.
Figure 2:
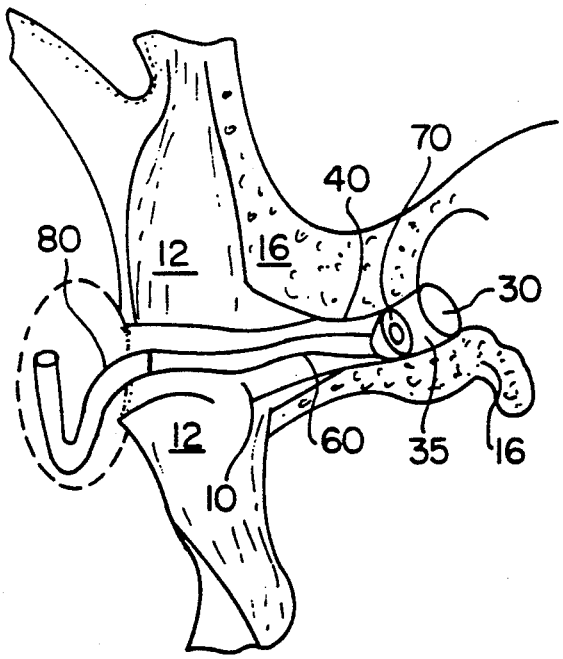
FIG. 2 is a pictorial representation of an embodiment of the earmold of the present invention inserted in the human ear (shown in cross section).

With reference to the figures where like elements have been given like numerical designations to facilitate an understanding of the present invention, and particularly with reference to the embodiment of the earmold of the present invention illustrated in FIG. 2, the earmold may be constructed of an acoustic conduction tube 60, a flanged tip 70, and a concha fitting 80. The resonant cavity 35 is formed between the tip 70 and the tympanic membrane 30.

Figure 3:
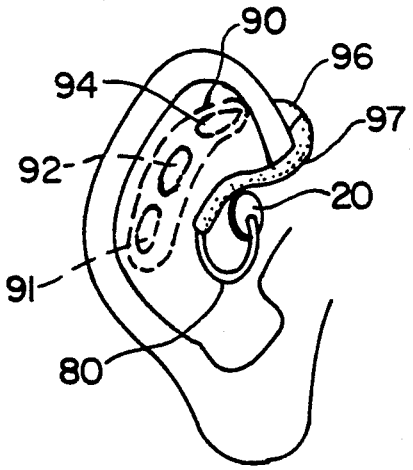
FIG. 3 is a pictorial representation of the human ear showing a behind-the-ear hearing aid fitted to the earmold of the embodiment of the present invention shown in FIG. 2.

As seen in FIG. 3, the earmold of the present invention is fitted to a hearing aid 90, which may be located in any suitable position, such as behind the ear, in the ear canal (not shown) or in the concha of the ear (not shown). The hearing aid 90 includes a microphone 91 to receive unamplified sound and convert it to electronic impulses, an amplifier 92 to amplify the received sound, a receiver 94 for converting electronic impulses into sound waves, and a conduction hook 96, which may include an extension 97, to convey the amplified sound to the concha fitting 80. To assure proper operation of the present invention, the hearing aid should neither prevent unamplified sound received at the ear from entering the ear canal, nor should it contact a substantial portion of the skin lining the ear canal.

With further reference to FIGS. 2 and 3, one end of the concha fitting 80 is attached to the end of the acoustic conduction tube 60 nearest the aperture 20, holding the tube in place so that it does not contact substantially the skin lining the ear canal. The fitting 80 is hollow and may be constructed of a suitable flexible material such as plastic. It may be a tube that fits into the concha 50 of the wearer and is held in place with slight pressure on the walls of the concha. The other end of the fitting 80 is connected to the hearing aid. In operation, amplified sound from the hearing aid is conveyed by air conduction through the conduction hook 96 and extension 97 to the fitting 80 and into the acoustic conduction tube 60. The length of the fitting 80 may be adjusted as required to fit other hearing aid locations. When the hearing aid 90 fits into the concha or into the canal, the fitting 80 may not be required.

Figure 4:
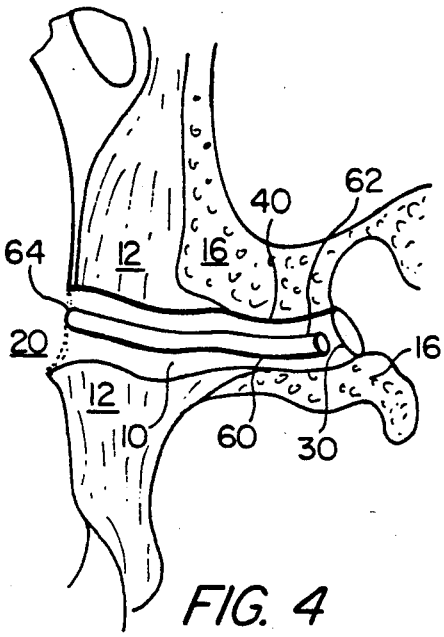
FIG. 4 is a pictorial representation of the acoustic conduction tube of the embodiment of the present invention shown in FIG. 2.

With reference now to FIG. 4, the acoustic conduction tube 60 is hollow with openings at the distal ends 62 and 64. The first end 62 is located inside the ear canal 10, preferably between the isthmus 40 and the tympanic membrane 30. While optimal results may be achieved when the first end 62 is located approximately 5 to 10 millimeters from the tympanic membrane 30, end 62 may be positioned in the canal as little as 5 millimeters from the aperture 20. The second end 64 is adjacent the aperture 20. The location of this end may vary, depending on the type of hearing aid and anatomy of the ear of the wearer. The tube 60 and the fitting 80 may be a single piece. The internal diameter of the tube 60 is dependent on the amount of hearing loss and curvature of the canal. The external diameter of the tube 60 is smaller than the ear canal 10 to prevent substantial contact. An external diameter about one-half the diameter of the canal has been found suitable.

The tube 60 may be constructed of a material that is rigid or semi-rigid longitudinally (that is, from end 62 to end 64) so that the tube may be inserted into the ear canal of the wearer and retain its shape. The tube should not sag or deform to touch the ear canal. To this end, it may be constructed of acrylic plastic, polyvinyl chloride (PVC), silicone, or similar noncorrosive material suitable for use in a human body cavity.

Figure 5A:
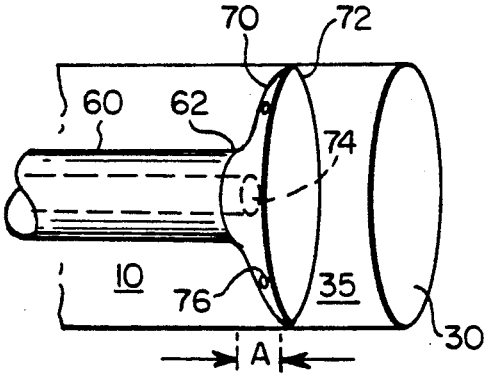
FIG. 5A is a partial pictorial representation of the flanged tip of the embodiment of the present invention shown in FIG. 2.

With reference now to FIG. 5A, the flanged tip 70 may be affixed to the tube 60 at the end 62 to form the resonant cavity 35. The tip 70 is desirably placed in the canal 10 so that between about one-third and about eighty percent of the volume of the canal 10 is not substantially occluded (i.e., reached by unamplified sound). The radially outward edge 72 of the tip 70 conforms to the oval shape of the ear canal 10 adjacent the end 62. The edge 72 creates a light seal by exerting only negligible pressure on the canal 10 wall. The tip 70 has a hole 74 near its center corresponding to the hole at the end 62 of the tube. The tip 70 may have a concavity facing the tympanic membrane 30 with tip thickness diminishing in the radially outward direction. The tip 70 should have sufficient thickness to give it lateral strength to resist movement of the end 62 to the wall of the canal 10. It has been found that suitable edge 72 thickness is approximately 0.05 to 2 millimeters. The longitudinal depth of the tip 70 (dimension "A") may be approximately 2 to 8 millimeters.

The tip 70 is constructed of a flexible material suitable for use in a human body cavity, such as silicone, polyvinyl, soft acrylic, and the like. While it has been found that these materials are suitable for reducing acoustic feedback through the ear canal, better results are achieved when the material is a syntactic foam (i.e., a composite of a polymeric matrix and microspheres). A suitable syntactic foam is commercially available from Epic, Inc. of Hardy, Va., under the trademark E-Compound and is more completely described in U.S. Pat. No. 4,811,402, issued Mar. 7, 1989.

Figure 5B:
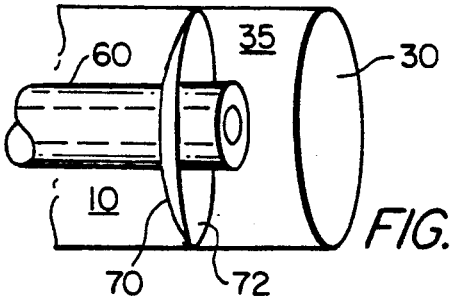
FIGS. 5B–5F are partial pictorial representations of alternative embodiments of the flanged tip of the present invention.
Figure 5C:
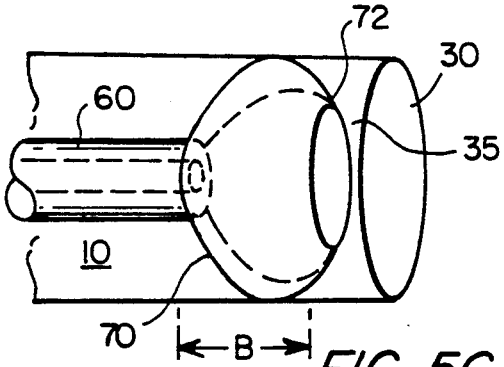
Figure 5D:
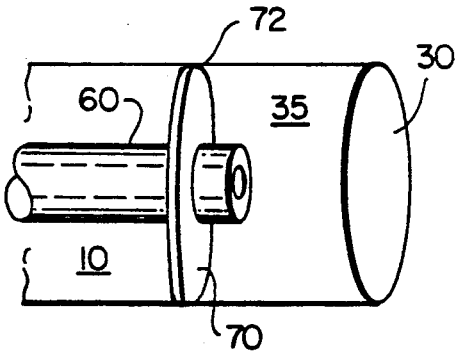
Figure 5E:
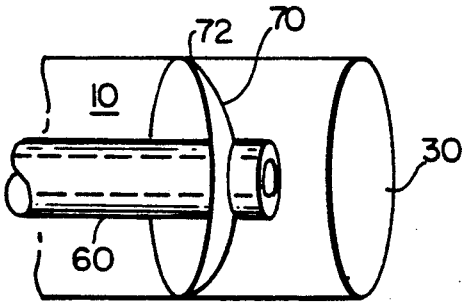
Figure 5F:
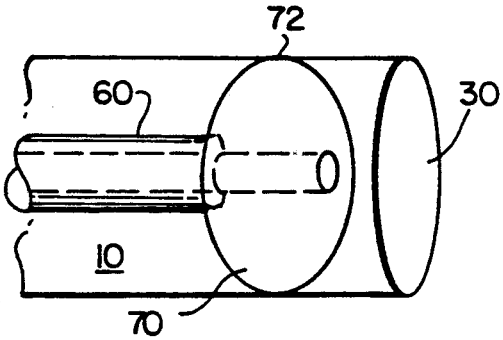

With reference now to FIGS. 5B–5F, wherein alternative embodiments of the flanged tip 70 are shown, the shape and location of the tip may be varied to tune the cavity 35 to the needs of the wearer, or for user comfort. As shown in FIG. 5B, the tip 70 may be arrayed circumferentially about the tube 60, rather than at the end 62. As shown in FIG. 5C, the tip 70 may be cup shaped with the diameter of the edge 72 smaller than the diameter of the canal. The depth of the cup (dimension "B" of this embodiment) may approximate the diameter of the canal 10. The flanged tip 70 may also be flat, convex, or ellipsoidal (FIGS. 5D–5F, respectively).

The flexibility of the flanged tip serves several purposes. First, the tip serves to form a sealed cavity adjacent the tympanic membrane. The sealing function reduces the amount of amplified sound which can travel outwardly and feedback into the microphone of the hearing aid. Second, the flexibility permits the seal to be obtained with only slight pressure against the wall of the ear canal. Third, the flexibility of the flanged tip permits the tip to be oscillated by the natural, unamplified sounds which arrive by air conduction through the ear canal. Thus, the resonant cavity which is formed by the flanged tip has one of its walls (the flanged tip) oscillating in response to the natural sound. Such oscillation is believed to raise the resonant frequencies of the cavity so that more amplification can be utilized without discomfort to the user.

The phase relationship between the sounds which reach the sealed cavity naturally through the ear canal and amplified through the conduction tube are complex and not totally understood in their effects on the sealed cavity. However, through conventional electronics, the phase of the amplified sound reaching the sealed cavity can be controlled with respect to the phase of the natural sounds which oscillate the flanged tip. By varying the phase relationship between the two sounds, a user of the earmold of the present invention may find a phase relationship that produces the most natural and effective hearing.

One or more small vent holes 76 may be provided in the flanged tip for venting the sealed cavity to the open portion of the ear canal. The volume of the hole (as measured by its diameter and length) determines the amount of acoustic feedback introduced when vent holes are added. Vent holes in prior art earmolds have volumes large enough to allow acoustic feedback of high frequencies (greater than about 2700 Hz), typically because of the great length of the vent. In the present invention, however, the vent holes may be positioned on the tip so that their length is less than about two millimeters and preferably less than 0.7 millimeters. The diameter of the vent may be about 0.5 millimeters. This small volume impedes passage of the high frequencies that may cause acoustic feedback. The cavity formed by the flanged tip is still to be considered sealed, regardless of the presence of the vent holes. The term "vent holes" as used herein also includes gaps in the radially outward edge of the flanged tip so that the seal with the wall of the ear canal is not complete.

Figure 6:
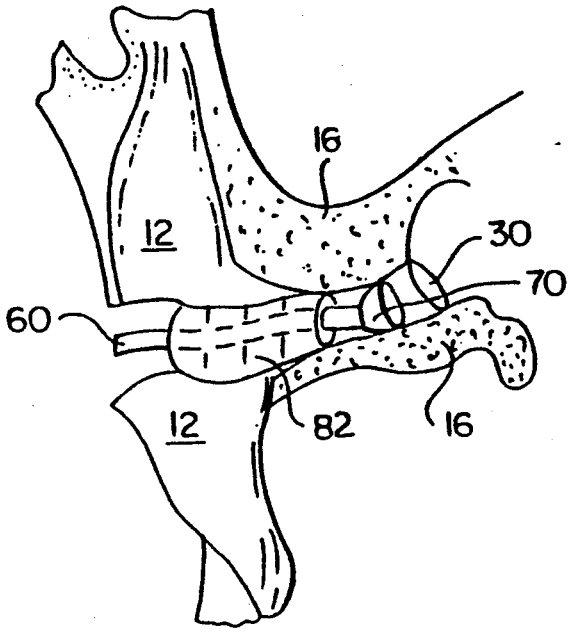
FIG. 6 is a pictorial representation of an embodiment of the earmold of the present invention showing a concentric external tube.
Figure 7:
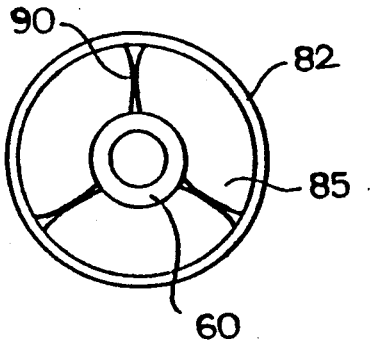
FIG. 7 is a vertical cross section at mid-length of the embodiment of FIG. 6.

With reference to new FIGS. 6 and 7, another embodiment of the present invention may include a second hollow tube external to and generally coaxial with the acoustic conduction tube 60. The exterior of the second tube 82 may contact the wall of the ear canal along a portion of the length of the acoustic conduction tube 60. The second tube 82 may support conduction tube 60 with support members 90. This support may be needed when, for example, the conduction tube 60 is not sufficiently rigid to support its own weight.

The space between the two tubes 60 and 82 forms a sound conduction passageway 85. The passageway 85 should be open at one end to the aperture 20 to receive unamplified sound and open at the other end to the wall of the ear canal adjacent the top 70, preferably past the isthmus, to allow bone-conducted sounds to reach the ear canal. As in the previously described embodiments the occlusion effect is prevented by venting bone-conducted low frequency sounds out of the ear canal, through passageway 85 in this embodiment. To this end, the support members 90 should not block the passageway 85.

Preferably, the earmold of the present invention is custom manufactured for a particular wearer so that the appropriate tip seal is achieved. While it may be produced in various standard sizes or as a one-size-fits-all earmold, these types of off-the-shelf earmolds probably will not produce all of the performance and comfort improvements found in the custom-made version.

The acoustic conduction tube 60 and flanged tip 70 may be constructed from a mold of the ear canal of the user. The mold is made by inserting a material such as silicone or ethyl methacrylate compound into the ear to create a shape that replicates the diameter and bends of the canal. To prevent damage to the tympanic membrane, a cotton or foam block on a thread is first inserted into the portion of the canal nearest the membrane. After allowing for shrinkage, the shape is used to form a female mold of the canal. The flanged tip is formed by using the portion of the female mold that replicates the shape of the canal between the isthmus and the tympanic membrane (except the innermost unmolded portion). The remainder of the female mold is used to form the tube. The tube and the tip are joined by heating or with an adhesive. The acoustic conduction path through the tube and tip is formed by drilling. The external diameter of the tube portion is reduced by grinding to about one-half the diameter of the canal.

While preferred embodiments of the present invention have been described, it is to be understood that the embodiments described are illustrative only and that the scope of the invention is to be defined solely by the appended claims when accorded a full range of equivalence, many variations and modifications naturally occurring to those skilled in the art from a perusal hereof.

We claim:

1. An earmold comprising:

(a) an acoustic conduction tube open at both ends for conveying amplified sound to the tympanic membrane at the inner end and the ear canal, said tube, when inserted into the ear canal, allowing unamplified sound received at the ear to reach into the ear canal to a first position at least as deep as the osseous portion thereof; and (b) a flexible disk affixed to said tube so that when said tube is inserted into the ear canal, said disk is adjacent said first position, said disk generally conforming to the ear canal at said first position, and having a hole coincident with the opening in the tube.

2. The earmold as defined in claim 1 wherein said first position is approximately five to ten millimeters from the tympanic membrane.

3. The earmold as defined in claim 1 wherein said first position is between the isthmus of the ear canal and the tympanic membrane.

4. The earmold as defined in claim 1 wherein said tube comprises a longitudinally rigid tube having an outer diameter smaller than the ear canal.

5. The earmold as defined in claim 1 further comprising a second tube external to and generally coaxial with said acoustic conduction tube for forming a sound conduction passageway therebetween, said second tube when inserted into the ear canal, generally conforming to the wall of the ear canal for a portion of the length of said acoustic conduction tube and having support members for holding said acoustic conduction tube without blocking said passageway, said passageway being open at one distal end to the unamplified sound and at the other distal end to the wall of the ear canal adjacent said first position.

6. The earmold as defined in claim 1 wherein said disk comprises a composite of polymeric matrix and microspheres.

7. The earmold as defined in claim 1 wherein said disk comprises a cup exerting nearly negligible pressure on the wall of the ear canal.

8. The earmold as defined in claim 1 wherein said disk has a concavity facing the tympanic membrane and is less than 2 millimeters thick at the radially outward edge.

9. The earmold as defined in claim 1 wherein said disk has one or more vent holes.

10. An earmold comprising an acoustic conduction tube adopted for insertion into the ear canal without shielding the ear canal from unamplified sound, and a disk for creating a resonant cavity next to the tympanic membrane affixed to said tube, said disk adapted to contact the wall of the canal only in the area of the canal between the isthmus and the tympanic membrane.

11. A hearing aid comprising:

(a) amplifier means for receiving an amplifying unamplified sound;

(b) a tube adapted for conveying amplified sounds from said amplifier means to a first end of said tube inside the ear canal at least as deep as the osseous portion thereof; and (c) a flexible flanged tip affixed to said tube for positioning said tube in a canal, the radially outward edge of said flanged tip adapted for contacting the wall of the canal adjacent said first end and for forming a resonant cavity next to the tympanic membrane, said tube and said amplifier means, when inserted in the ear canal, leaving the portion of the canal extending from the ear aperture to said flanged tip exposed to the unamplified sound.

12. The hearing aid as defined in claim 11 wherein said flanged tip comprises a cup affixed to said first end, the outer perimeter of said cup exerting nearly negligible pressure on said wall.

13. A method for making an earmold comprising the steps of:

(a) forming an open-ended hollow tube having an external circumferential surface corresponding to the shape of the ear canal of the user, said tube having a first distal end adapted to be positioned at least five millimeters inside the ear canal and a second distal end nearer the ear aperture;

(b) reducing the external diameter of said tube; and (c) affixing to said tube in the vicinity of said first end a disk of flexible material having a radially outward edge that generally conforms to the ear canal in the area of said first end.

14. The method as defined in claim 13 further comprising the steps of:

(d) creating a concavity on the face of said disk facing the tympanic membrane; and (e) reducing the thickness of the disk at the radially outward edge to less than 2 millimeters.

15. The method as defined in claim 13 further comprising the step of:

(d) creating one or more vent holes in said disk, said holes having a diameter of approximately 0.5 millimeters and a length of less than approximately two millimeters.

16. The method as defined in claim 13 further comprising the step of:

(d) forming said flexible material from a composite of polymeric matrix and microspheres.

17. The method as defined in claim 13 wherein said first distal end is adapted to extend into the canal to a position between the isthmus and the tympanic membrane and said tube is formed from a longitudinally rigid material.

18. A method for making a hearing aid comprising the steps of:

(a) providing amplifier means for receiving and amplifying unamplified sound and for conveying the amplified sound to the ear canal, said amplifier means not preventing unamplified sound from entering the ear canal when worn by a user;

(b) forming an open-ended hollow acoustic conduction tube having an external diameter corresponding to the diameter of the ear canal and a first distal end adapted to be positioned at least five millimeters inside the ear canal;

(c) reducing the external diameter of said tube whereby said tube does not contact the wall of the canal when inserted into the canal;

(d) affixing a flexible flanged tip to said first end, said flanged tip having a radially outward edge generally conforming to the wall of the ear canal when inserted into the ear canal;

(e) forming a concavity on the face of said flanged tip facing the tympanic membrane;

(f) reducing the thickness of said flange to less than about 2 millimeters at the radially outward edge; and (g) affixing the second distal end of said tube to said amplifier means.

19. A hearing aid comprising a disk for creating a resonant cavity in an ear canal beyond the isthmus thereof next to the tympanic membrane, and an amplifier for conveying amplified sound into said cavity and for allowing unamplified sound to reach into the ear canal at least as far as the osseous portion thereof.

20. The hearing aid of claim 19 wherein said amplifier is located in the ear canal.

21. The hearing aid of claim 19 wherein said resonant cavity is created beyond the narrowest portion of the isthmus.

22. A method of aiding hearing comprising the steps of:

(a) flexibly sealing the ear canal to create a sealed cavity beyond the isthmus of the ear canal next to the tympanic membrane;

(b) providing an amplifier for conveying amplified sound into said cavity; and (c) positioning said amplifier in the ear canal so that unamplified sound can reach into the ear canal at least as far as the osseous portion thereof.

23. In a hearing aid comprising sealing means for creating a cavity in an ear canal and amplifying means for conveying amplified sound into said cavity, the improvement comprising placement of said sealing means and said amplifying means so that unamplified sound reaches into the ear canal at least as far as the osseous portion thereof.

24. The hearing aid of claim 23 wherein said sealing means and said amplifying means are placed so that unamplified sound reaches into the ear canal at least as far as the isthmus thereof.

25. The hearing aid of claim 23 wherein said sealing means is integral with said amplifying means.

26. The earmold as defined in claim 10 wherein said disk is adapted to contact the wall of the ear canal between the narrowest portion of the isthmus and the tympanic membrane.

27. The earmold as defined in claim 3 wherein said first position is between the narrowest portion of the isthmus and the tympanic membrane.

28. The hearing aid of claim 23 wherein between about one-third and about eight percent of the volume of the ear canal is not substantially occluded by the hearing aid.

* * * * *

UNITED STATES PATENT AND TRADEMARK OFFICE

CERTIFICATE OF CORRECTION

PATENT NO. : 5,201,007

DATED : April 6, 1993

INVENTOR(S) : Ward, et al.

It is certified that error appears in the above—identified patent and that said Letters Patent is hereby corrected as shown below:

In the claims, Column 10, line 35, replace "eight" with -- eighty --.

Signed and Sealed this

Third Day of May, 1994

Bruce Lehman

*Attest:*

BRUCE LEHMAN

*Attesting Officer*

*Commissioner of Patents and Trademarks*